United States Patent [19]

Bente

[11] 4,430,810

[45] Feb. 14, 1984

[54] SOLE FOR SPORTS SHOES, PARTICULARLY FOR SHOES USED FOR LONG-DISTANCE RUNNING ON HARD TRACKS

[75] Inventor: Alfred Bente, Herzogenaurach, Fed. Rep. of Germany

[73] Assignee: Adidas Sportschuhfabriken Adi Dassler KG, Herzogenaurach, Fed. Rep. of Germany

[21] Appl. No.: 288,182

[22] Filed: Jul. 29, 1981

Related U.S. Application Data

[63] Continuation-in-part of Ser. No. 117,195, Jan. 31, 1980.

[30] Foreign Application Priority Data

Feb. 7, 1979 [DE] Fed. Rep. of Germany ..... 2904540
May 31, 1979 [DE] Fed. Rep. of Germany ..... 2922136
Aug. 1, 1980 [DE] Fed. Rep. of Germany ..... 3029258

[51] Int. Cl.[3] ..... A43B 13/04; A43B 5/04; A43D 5/00

[52] U.S. Cl. ..... 36/32 R; 36/121; 36/136; 12/103; 272/100

[58] Field of Search ..... 36/32 R, 28, 102, 103, 36/105, 107, 132, 117, 121, 136; 12/103; 272/57 D, 80

[56] References Cited

U.S. PATENT DOCUMENTS 3,785,646 1/1974 Ruskin ..... 36/32 R
4,235,026 11/1980 Plagenhoef ..... 36/32 R
4,262,433 4/1981 Hagg et al. ..... 36/32 R

*Primary Examiner*—Patrick D. Lawson

[57] ABSTRACT

The invention relates to an outsole for sports shoes, particularly for shoes used for long-distance running on hard tracks. The outsole consists of a soft elastically flexible material, preferably plastics material, and is thickened rearwardly in wedge formation. In the region of the heel tread surface of the outsole, there is provided a recess which is open towards both side edges of the sole and in which a resilient elongate supporting member is fittingly insertable. Preferably a plurality of supporting members are inserted in corresponding recesses adjacent one another. The supporting members are replaceable and permit the effective sole flexibility in the region of the heel tread surface to be adapted to the individual requirements of the runner and the track.

7 Claims, 10 Drawing Figures

SOLE FOR SPORTS SHOES, PARTICULARLY FOR SHOES USED FOR LONG-DISTANCE RUNNING ON HARD TRACKS

This application is a continuation-in-part of application Ser. No. 117,195, filed Jan. 31, 1980.

The invention relates to a sole for sports shoes, especially for shoes used for long-distance running on hard tracks, composed of elastically flexible material, preferably plastics material, and thickened rearwardly from the shank to form a heel wedge.

For many years it has been conventional to provide running shoes and also training shoes for running races with a rounded-off portion at the heel, the rounded-off portion extending right into the sole to ensure a uniform rolling-off process for the foot and thereby increase the performance of the runner. This rounded-off portion has produced the desired result in contests held on plastics tracks, particularly short-distance and medium-distance races, because in these disciplines the runners make relatively far forward contact with the sole surface by extending the foot with a view to increasing the performance, so that during the rolling-off process the heel is not fully loaded. However, it has been found that in long-distance races in which the force of the runner does not usually suffice over the full distance so that the heel does not make contact under full load, the said rounded-off portion has a detrimental effect and in an extreme case can even result in overloading of the heel. Such detrimental effects are particularly evident in long-distance races such as marathon races which lead over relatively long distances and therefore include stretches along ordinary roads. When there is heel contact with the rounded-off portion of the sole, the hard road surface causes the elasticity of the sole to be incompletely utilized and the runner is subjected to shocks in the region of the heel bone that lead to premature tiring and a marked drop in performance. Similar considerations apply to running or training shoes used by inexperienced runners, for example within the scope of slimming exercises, because such persons generally also fail to have special knowledge about the technique of running to take the aforementioned problems into account.

To damp vibrations and shocks occuring during running, particularly on hard tracks, various solutions have already been proposed. For example, a sports shoe of the aforementioned kind is known in which an air cushion chamber is formed in the heel region of the sole and closed by a valve. This air cushion chamber is supposed to absorb and damp vibrations and impacts elastically by pressure deformation. The provision of comparatively thick soles of very soft flexible material has the same aim in mind. However, both known constructions have a significant disadvantage in that, in order to achieve adequate damping, they are so compressible in the heel region of the sole that the runner has a floating feeling imparted to him and loses the feel of the track which is necessary to develop his best performance. Indeed, premature tiring of the runner is likely when using an excessively soft sole which no doubt has a good damping effect for impacts.

Further there has been suggested in U.S. Pat. No. 4,235,026 to Plagenhoef a sports shoe sole designed specifically for athletic activities wherein the sole contains at the outer side of the heel and the inner side of the ball transversely extending, longitudinally spaced openings which extend to approximately the longitudinal center line and wherein the respective opposite sides are substantially solid, thereby allowing the sole to yield at the outer side of the heel end to a greater extent than at the inner side and at the inner side of the ball to a greater extent than at the outer side. Thereby, however, similarly as with the soles having air cushion chambers discussed above, the sole is weakened in those regions having the openings and thereby is liable to impart a floating feeling to the runner. It is true, there is suggested in the Plagenhoef Patent to locally add to resistance to displacement of the sole by attaching elastomeric tubes to the base portions of several of the openings. These tubes, however, are effective only when the heel portion of the sole has been compressed already to a considerable extent by the weight of the runner thereby abruptly increasing the sole stiffness. Thus the floating feeling during the normal performance of the runner is not avoided, while the sole exhibits an increased hardness or stiffness during phases of excess loading.

The invention therefore has the object of suggesting a sports shoe sole in which, on the one hand, there is substantial damping of vibrations and impacts occurring during running particularly on hard tracks and the unhealthy effects on the heel are thereby avoided without thereby affecting the performance of the runner. However, at the same time it should be possible to employ one and the same sole consisting of relatively soft material for this purpose or to adapt the sole to different ground conditions, for example forest soil or asphalt.

The invention suggests that, in the region below the tread surface for the heel, the outsole comprises at least one recess which extends transversely to the longitudinal axis of the sole and substantially parallel to the tread surface, is open to both side edges of the sole and in which at least one supporting member can be recplaceably and fittingly inserted, said supporting member being made of a bendable material which is of greater hardness than the soft yielding material of the sole to increase the overall hardness of the sole.

The invention is therefore based on the consideration that the selection of appropriate supporting members will make it possible to change the softness of the sole itself. In this way adaptation to the wishes of the runner is possible without difficulties, regardless whether with respect to his weight or the softness of the sole, in some cases also taking the ground properties into consideration. If relatively stiff supporting members are used, the outsole seems to be given a comparatively high hardness. On the other hand, when using supporting members which are comparatively easily resiliently deformable, the increase in the apparent sole hardness is not so high. For example, the sole itself may be of foam material, e.g. polyurethane foam having a comparatively low Shore hardness of, for example, about 35. Depending on the properties of the supporting members that are used, the apparent Shore hardness of the sole can then be considerably increased, e.g. to a maximum of 85. The supporting members can be made of all possible materials. For example, PVC, polyethylene, polyamide and especially nylon are suitable. However, it would also be possible to make the supporting members of suitable metal, e.g. an appropriate sheet metal. The application of the supporting members to the sole is simple because the recess is laterally open. Generally it is only required to insert the supporting members appropriately from the side. By selecting a suitable colour, the weight range for which a particular supporting member is intended can then be made visible. It is, for example, conceivable to let the colour become darker with an increase in weight of the runner for whom they are determined.

It is favourable to make the supporting members in the form of hollow members of elastically bendable material in order thereby to save material and also facilitate simple adaptation to a particular load.

To adapt or change the spring properties, it is also possible to shape the hollow member accordingly, in particular to provide the hollow member with slots, ribs or like elements, whereby the bending flexibility is altered.

A particularly simple but also desirable construction for the sole according to the invention resides in that the heel wedge is provided with a plurality of parallel transverse bores in which substantially tubular supporting members are insertable. It will be known that, having regard to their wall thickness, tubes possess the highest relative strength and therefore use the least possible material. In addition, no particular orientation of the tubular supporting members is necessary in the recess. One advantage of using a plurality of tubular supporting members is also that under certain circumstances the hardness of the sole can be differently selected in the region of different supporting members by inserting different tubular supporting members in the bores.

The insertion of the tubular supporting members is easy when the transverse bores are open at both ends and the tubular supporting members are transversely sub-divided into two parts which are each insertable in the associated transverse bore from opposite side edges of the sole and can be intercoupled near their inner ends in the operative position. However, the supporting members could be differently constructed. Thus, the supporting members could be in one piece and, as a supporting element, carry at least at one end an elastic ring which can be snapped into a circumferential groove in the end portion of the supporting members and at their other end carry a collar or likewise an elastic ring which can be snapped into a circumferential groove. If transverse bores are provided and the supporting members are to be relatively soft, i.e. the sole is to be used by persons of low weight, it is for example conceivable to use a spiral supporting member of plastics material or metal. Such a supporting member could then be uniformly screwed into the transverse bore from the side. Although a plurality of parallel supporting members will preferably often be provided in the sole, it would be conceivable for certain applications to provide only one suitably shaped supporting member which could possibly also be inserted in a recess from the heel end of the sole rather than from the side but in that case suitable provision must be made for securely closing the recess.

The present invention is concerned with a further improvement and aspect of the invention as set forth above, in particular in regard to influencing the cushioning capability of the sole by the support member or members.

For this purpose, the present invention proposes that the recess in the heel wedge of the sole is narrower in cross-section, at least in a region-wise manner, than the support member for fitting therein.

As the heel wedge comprises a comparatively soft material, for example a polyurethane foam, for properly performing its function, while the support member, although being capable of deformation in compression and/or bending, for properly performing its function, is nonetheless of greater hardness than the material of the heel wedge, taken generally, for the purposes of establishing the cushioning capability, the heel wedge is subject to a compression effect in the region around the recess, after the support member is inserted. It will be appreciated that this compression effect in the region around the recess results in the material having a higher degree of resistance to compression and bending deformation, that is to say, the heel wedge is locally stiffened in the region around the recess or recesses. The extent of local compacting of the heel wedge material depends on the degree of oversize by which the outside dimensions of the support member exceed the inside dimensions of the recess before the support member is fitted thereinto. In this way, the stiffening action in respect of the heel wedge under the heel support surface, which is the aim to be achieved in accordance with the principle of this invention, may be achieved to a certain extent by a deliberately produced compression effect in the material of the heel wedge.

This is advantageous for the reason that the stiffening in the sole, which can be achieved in this way, does not occur abruptly at the boundary surface of the recess with the support member, but is already beginning to occur in the heel wedge itself, and gradually increases towards the recess. In addition, this arrangement makes it possible for the support members and the recesses to be of smaller dimensions as the lower levels of hardness and bending strength which result from the reduced dimensions are compensated for by the resulting compression effect and thus stiffening effect in the region around the recess.

In accordance with an advantageous development of this invention, the support member is in the form of a plurality of solid bar members of plastics material, which are capable of deformation in compression and/or deformation in bending and which are provided at one end with a collar portion intended to bear against the edge of the sole, while in their other end portion, the bar members have a plurality of spaced-apart annular collar portions. As a result of the support members being oversized relative to the recess, the wall of the recess presses forcefully against the outside surface of the support members. Therefore, with the above-described advantageous configuration of the support member, there is no need to take special steps for fixing the support members in the recess. In particular, the wall of the recess presses into the intermediate spaces which are formed between the annular collar portions in one end section of the support member, and thus, in addition to a considerable frictional grip, also produces a positive or form-locking engagement which prevents the support members from unintentionally coming out of the recess while the wearer of the shoe is running.

In order to be able to fit the support members into the recess, in spite of the oversize of the support members, the invention proposes a simple device which is particularly suitable for that purpose. The device is intended for a sole design in which the recess or recesses is or are open to the oppositely disposed edges of the sole. According to the invention, the device comprises a tube which has a pushing and pulling handle and which can be inserted into the recess in the sole, thereby simultaneously expanding the recess, the internal cross-section of the tube, in respect of shape and dimensions, being suitable for receiving a support member and being adapted thereto, and the length of the tube at least approximately corresponding to the length of the recess. The tube can be inserted into the recess, thereby causing the recess to be enlarged, in such a way that the free end of the tube lies in the vicinity of the corresponding end of the recess, or even projects out of that end of the recess. A support member is now introduced into the tube so that the collar portion provided on the support member at the end thereof bears against the end of the tube of the device, and the tube is pulled back again through the recess. The support member remains with its end collar portion bearing against the edge of the sole, around the mouth of the recess, and is pulled out of the tube as the tube is moved backwards out of the recess. In this operation, the wall of the recess progressively comes to bear against the outside surface of the support member and embraces the outside surface of the support member with a frictional and positive engagement, in the manner described hereinbefore.

Desirably, the tube is locally expanded outwardly just before its free end, thereby forming a flat or shallow bead, and the free end forms a readily deformable thin-walled edge portion. The thin-walled edge portion permits the tube to be easily inserted into the recess; the local bead configuration reduces the force required for inserting and retracting the tube.

Other features, details and advantages of the invention will become evident from the following description of preferred examples with references to the drawing, wherein.

Figure 1:
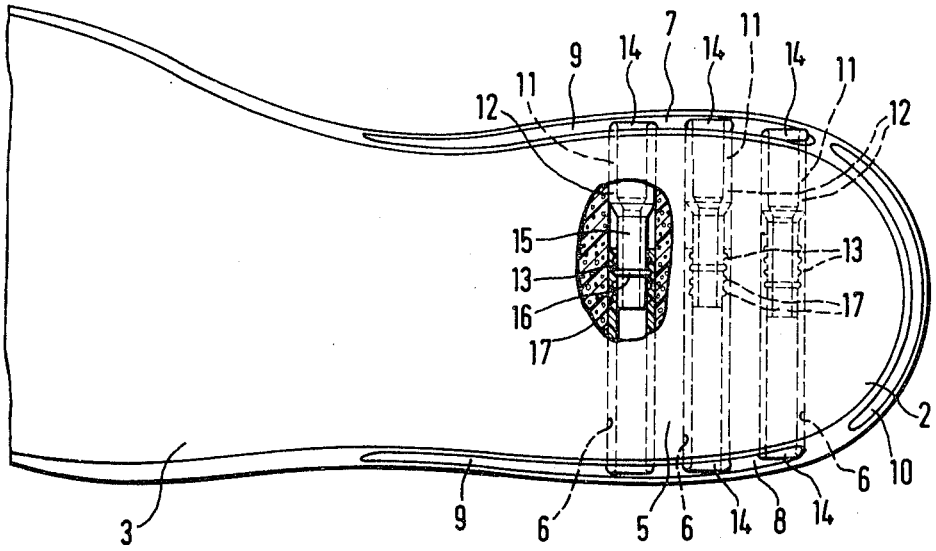
FIG. 1 is a part-sectional plan view of a sole according to the invention.
Figure 3:
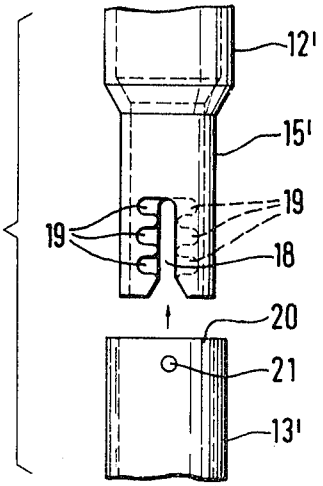
Figure 4:
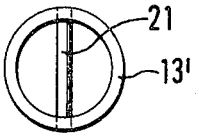
Figure 5:
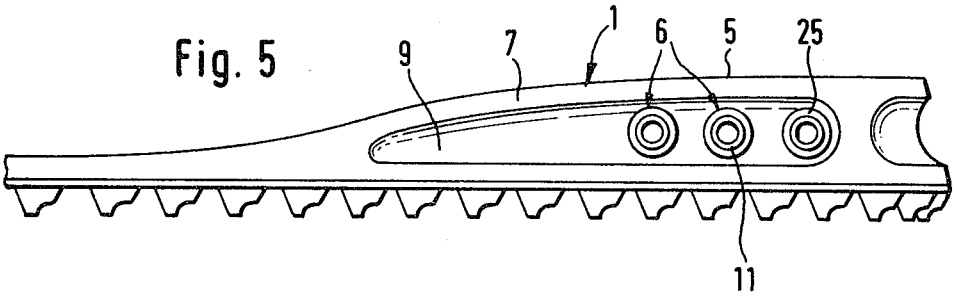
Figure 6:
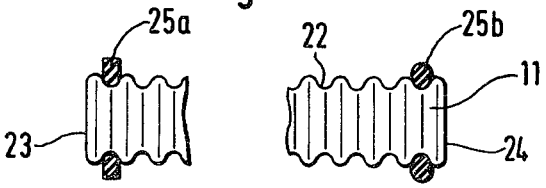
Figure 7:
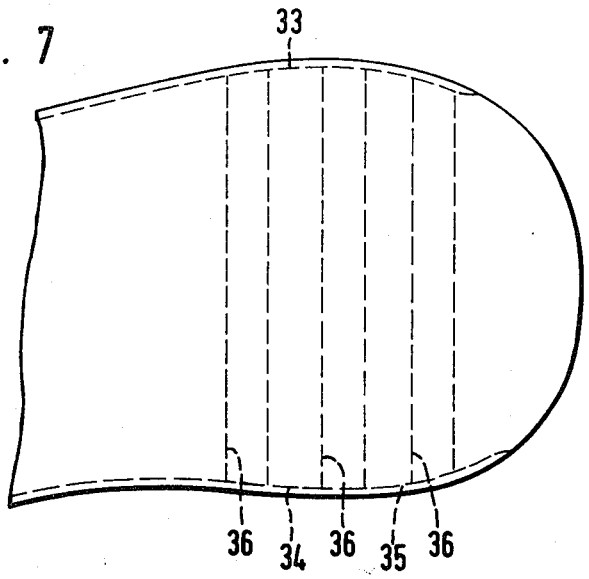
Figure 8:
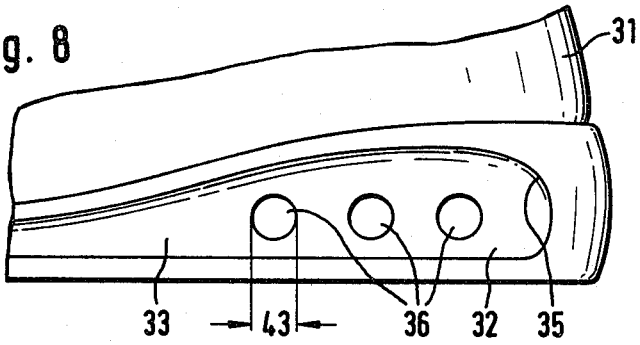
Figure 9:
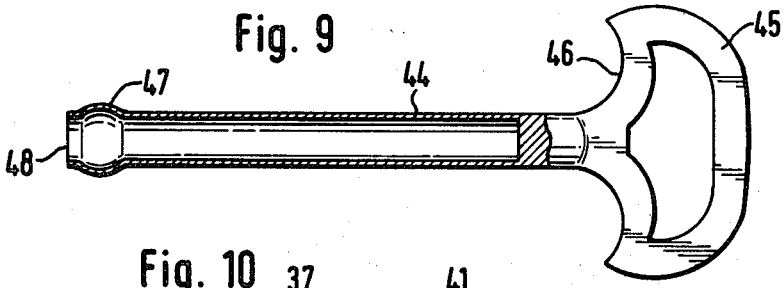
Figure 10:
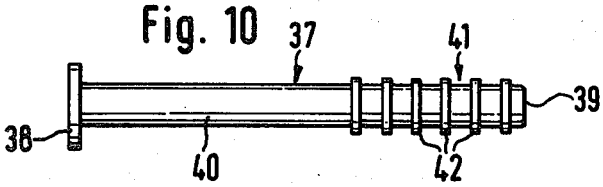

FIG. 3 shows to a very much enlarged scale the inner ends of two tube portions which form the supporting member, the latter being modified compared with that of FIG. 1, FIG. 4 is an underplan of FIG. 3, FIG. 5 is a fragmentary side elevation of a modified construction, FIG. 6 is an enlarged fragmentary view of a supporting member used in the sole of FIG. 5, FIGS. 7 and 8 show a view from below and a side view respectively of part of a heel region of a modified embodiment of a sports shoe provided with a sole according to the invention, FIG. 9 shows a device for inserting a support member into the sole shown in FIGS. 7 and 8, and FIG. 10 shows a support member for fitting into the sole shown in FIGS. 7 and 8.

Figure 2:
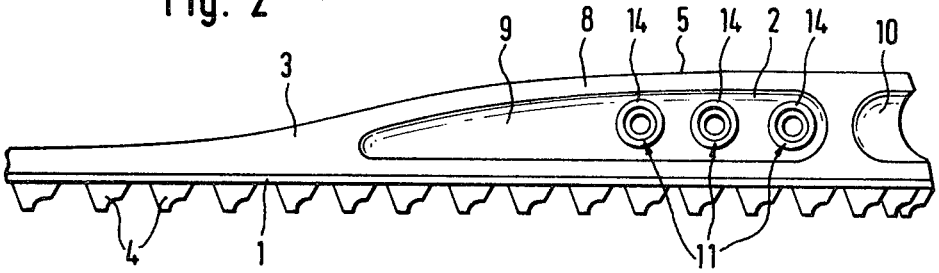
FIG. 2 is a side elevation of the FIG. 1 sole.

The sole shown in FIGS. 1 and 2 consists of an actual outsole 1 of wear-resistant material, e.g. vulcanized rubber, and a portion 3 forming the heel wedge 2 of relatively soft material, e.g. polyurethane foam with a Shore hardness of about 35. The heel portion 3 is securely connected to the outsole 1 by appropriate means, e.g. adhesive. The outsole 1 in the illustrated example is also provided with studs 4.

In the region beneath the contact surface 5 for the heel, the illustrated sole is provided with three transverse bores 6 extending from one side edge 7 of the sole to the other side edge 8, the transverse bores 6 each terminating in the vicinity of depressions 9 in the side edges 7, 8 of the sole. Incidentally, a corresponding depression 10 is also provided at the rear end of the sole.

In the illustrated embodiment, tubular supporting members 11 are inserted in the respective transverse bores 6 and these consist of a suitable plastics material, e.g. PVC, polyethylene, polyamide or particularly nylon. The use of metal as a material for the supporting members 11 is also conceivable.

Each supporting member 11 consists of two tube portions 12 and 13 of which the outer ends each have an annular flange 14 abutting the side wall 7 or 8 of the wedge member 3 in the region of the depression 9.

The inner ends of the tube portions 12, 13 are constructed so that they can be intercoupled. For this purpose the one tube portion 12 has a reduced inner end section 15 which engages inside the second tube portion 13. This reduced end section 15 is provided on the outside with an annular head 16 which, for locking the tube portions 12, 13, is engageable during insertion of the reduced end section 15 of the tube portion 12 into the inner end of the tube portion 11, with annular grooves 17 provided on the inner wall of the tube portion 11, the annular bead 16 being engaged in a suitable annular groove 17 depending on the desired length of the supporting member 11.

In the two left-hand supporting members 11 of FIG. 1, the annular bead 16 is engaged in the second annular groove as viewed from the inner end of the tube portion 13, whereas for the right-hand supporting member the locking takes place in the fourth annular groove whereby the right-hand supporting member as a whole is considerably shorter which corresponds to the narrower width of the sole or the wedge portion 3 at this point.

To insert the supporting member 11, the tube portions 12 or 13 are introduced in the transverse bores 6 from the respective ends thereof and then pressed into each other so strongly while interlocking the annular bead 16 and the appropriate annular groove 17 until a proper seating of the tube portions 12, 13 has been achieved in the transverse bore 6 with the annular flange 14 abutting the side wall 7, 8.

If the supporting members 11 are to be replaced, the tube portions 12, 13 must be pulled apart and out of the respective transverse bore. For this purpose, the tube portions 12, 13 may be provided with suitable holding elements, e.g. apertures or the like which are not visible in the drawing. If the annular flange 14 projects sufficiently beyond the periphery of the tube portions 12,13, the latter can also be gripped at the annular flange 14 itself.

Appropriate tubular supporting members 11 are inserted depending on the weight of the user of the shoes and the hardness of the sole desired by him. The 'hardness' of the supporting members 11, i.e. their deformability, can be set by selecting a suitable material, by varying the wall thickness and possibly also by appropriate shaping. For example, the 'hardness' can be reduced by applying slots, which could also extend spirally. An increase in the 'hardness' can for example be achieved by means of webs, ribs or the like.

FIGS. 3 and 4 illustrate a different embodiment of the means for coupling the inner ends of the tube portions 12' or 13'. In the FIGS. 3 and 4 embodiment, one tube portion 12' is again reduced at its inner end 15' so that it can be pushed into the inner end of the other tube portion 13'.

The coupling means between the two tube portions 12', 13' are in the nature of a bayonet coupling. For this purpose the reduced end section 15' of the tube portion 12' comprises two diametrally opposed axial slots 18 from which radial locking notches 19 extend in the same circumferential direction. These locking notches 19 serve as locking elements for a pin 21 which passes transversely through the other tube portion 13' near its inner end 20 and which may be of metal if the tube portion 13' is of plastics material.

For locking purposes, the inner ends of the tube portions 12', 13' in the FIGS. 3 and 4 embodiment are pushed into each other sufficiently far and, by turning the tube portions 12', 13' with respect to each other, the pin 21 is then introduced in one of the locking notch pairs 19 which extend laterally from the axial slots 18, whereby locking is achieved. Since again a plurality of locking notches 19 is provided in different axial positions, the tube portions 12', 13' can be intercoupled in different axial positions whereby a compensation in length is likewise possible in the manner described in relation to FIG. 1.

In the FIGS. 3 and 4 embodiment, the tube portions 12', 13' should be provided at their outer ends with suitable engagement means for turning tools. For example, their outer end could be equipped with a slot for applying a screwdriver. Another possibility would be to make the head at the outer end polygonal on the inside or outside.

In the same way as for the outsole according to FIGS. 1 to 4, three transverse bores 6 are provided in the region of the contact surface 5 for the heel in the case of FIG. 5, the bores 6 extending from one side edge 7 of the sole to the other side edge. The transverse bores 6 are disposed in the vicinity of the depressions 9 of the side edges of the sole and terminate therein.

Tubular supporting members 11' are inserted in the transverse bores 6, one of these being shown in FIG. 6. The supporting member 11' is a length of a plastics tube of corrugated longitudinal section and thus provided over its entire length with circumferential grooves. The length of the tube is such that, after it has been inserted in the transverse bore 6, both its ends 23 or 24 still project so far from the apertures of the transverse bores 6 that at least one circumferential groove 22 is disposed completely beyond the transverse bores 6. An elastic ring 25*a* or 25*b* of rubber or the like is snapped into this circumferential groove 22 so that it is tightly seated in the base of the groove and is held by the groove 22. FIG. 6 illustrates two different embodiments 25*a* and 25*b* for the ring cross-section. It will be evident that any desired other forms of elastic rings can be selected to fulfil the same purpose. The only thing that is necessary is that even after snapping in the side faces of the ring 25*a, b* still project sufficiently far beyond the circumferential surface of the tube to achieve an abutment and thus a supporting effect at the lateral edges of the sole.

Before insertion in the transverse bores 6, the tube 11' can be provided with a lubricating agent such as Vaseline which accumulates at the bottom of at least a few grooves 22. In this way insertion of the tube is very much simplified.

Departures can be made within the scope of the invention from the shape of the grooves as well as from the illustrated circular cross-section of the tube 11'. It is also sufficient to provide the grooves merely in the two end portions 23 or 24 on which the rings 25*a, b* are placed. Further, it is possible to provide one end of the tube 11' with a collar projecting beyond the exterior of the rollers 22, for example by lateral fusion, so that an elastic ring 25*a, b* need be snapped only onto one end 23 or 24.

The sports shoe of which FIGS. 7 and 8 show only the heel region of the sole, is for example a tennis shoe with an uppers portion 31 and an outer sole in the form of a dished-type sole which at least in the heel region forms a heel wedge 32. In the usual manner, the dished-type sole is taken somewhat up the uppers portion 31 of the shoe and is joined thereto by adhesive or by stitching or by being directly injected thereon. At least in the region forming the heel wedge 32, the sole comprises a light and comparatively soft polyurethane foam which has a Shore hardness of about 35. The tread or ground-engaging side of the sole is provided with tread profiling (not shown herein).

A shallow edge recess 35 is formed at each of the two opposite side edges 33 and 34 of the sole. Three bores 36 which extend parallel to each other open into the two recesses 35 in the edges of the sole; the bores 36 extend between the heel support surface and the tread side of the heel wedge 32, and parallel thereto. The bores 36 are directed transversely with respect to the longitudinal direction of the sole, and are also substantially parallel to each other. The distances between the bores are desirably equal, but this is not necessarily the case; it is possible to envisage the front bore 36 being positioned somewhat further forward.

A bar-shaped support member 37 as shown in FIG. 10 is intended for fitting into the bores 36. The support member 37 comprises an elastomeric plastics material, for example an elastically yielding polyurethane, and is both capable of deformation in compression and also resiliently bendable transversely with respect to the longitudinal axis thereof. At its left-hand end, the support member 37 has a collar portion 38 which, when the support member is fitted into the bore 36, is intended to bear respectively against the side edge 33 or 34 of the sole or in the bottom of the recess 35. At the opposite end 39 of the support member, the diameter of the support member 37 is no greater than in the cylindrical shank portion 40 adjoining the collar portion 38. Provided in the end portion 41 which is in front of the free end 39 are six spaced-apart annular collar portions 42, the outside diameter of which is less than the outside diameter of the collar portion 38. In a practical embodiment, the shank diameter of the annular collar portions is 10 mm.

The diameter 43 of the bores 36 is smaller than the shank diameter of the shank portion 40. The difference in diameters may be for example up to 1 mm and more. When therefore the support member 37 is fitted into one of the bores 36 in such a way that it extends from one end of the bore to the other end, then the support member compresses and compacts the material of the heel wedge 32 in the region around the associated bore 36, and stiffens the heel wedge 32 in respect of further compression and bending deformation, as described hereinbefore.

In addition, the wall of the corresponding bore 36 presses locally into the axial intermediate spaces which are formed between the annular collar portions 42, and fixes the support member in the bore 36, so as to prevent unintentional axial shifting thereof. There is therefore no need to take special steps to fix the support member in the bore.

Because of the oversize in respect of diameter of the support member 37 relative to the bore 36, it is difficult for the support member 37 to be readily inserted into the bore 36. The device shown in FIG. 9 is provided for that purpose, and substantially comprises a tube 44 and a handle 45 which is fixedly connected thereto. The handle 45 is of such a configuration that the tube 44 can be pressed into one of the bores 36, using the palm of a hand, but can subsequently be pulled out of the bore again by gripping the handle with fingers around round recesses 46. The length of the tube 44 is at least equal to the length of the support member 37; the inside diameter of the tube 44 is such that the support member 37 can be easily introduced thereinto. In the vicinity of the free end of the tube 44, the wall of the tube is bulged out to form a shallow bead 47. Disposed adjoining the bead 47 is an edge portion 48 which is of thinner wall thickness and which is easily deformable, in comparison with the rigidity of the wall of the tube 44.

The support member 37 is inserted by means of the device shown in FIG. 9 by the tube 44 first being pushed through one of the bores 36 until it projects out of the opposite mouth end of the bore. A support member 37 is then introduced into the tube 44, and the tube is then pulled back. As the tube is pulled back through the bore, the collar portion 38 comes to bear against the respective edge 33 or 34 of the sole or the bottom of the associated recess 35 so that, as the device is pulled further back through the bore, the support member 37 is pulled slowly out of the tube 44. The bead 47 ensures that the wall of the bore 36 comes to lie properly against the outside surface of the support member 37, in the region of the free end 48 of the tube.

The device preferably comprises an elastically deformable plastics material, for example polyamide.

In the above-described embodiment, the bores 36 are smaller in cross-section, over their entire length, than the support members 37 so that the material surrounding the bores 36 is compacted over the entire length of the bores. However, that is not necessarily the case. It is also possible for the oversize in respect of the support members 37 in relation to the diameter 43 of the bores 36 to be provided only in the end regions of the support members 37, which is desirably effected by a shoulder in the region of the collar portion 38 and by the annular collar portions 37. Compacting of the material which results from this arrangement, in the end regions of the support members 42.also gives the desired effect according to the invention, of a continuous increase in rigidity laterally of the point of main loading by the heel, while in addition providing the desired action of fixing the support members 37, within the bore 36 without additional holding means.

In the above-described embodiment, the bores 36 are straight and are arranged parallel to the support surface or tread side of the sole, and the support members 37 are correspondingly straight. In this respect also however it is possible to achieve better adaptation to the curved underneath surface of the human heel, if either the bores 36 are of such a configuration as to be curved downwardly in the heel wedge 32 so that the support members 37, which are then inserted with a given degree of prestressing, form in their entirety a downwardly curved 'grid', or if the support members 37 are increased in thickness in an upward direction in their end regions before the collar portion 38 and in the region 41, so that, in those regions, the support members cause a more accentuated compacting action than in their central region, in the material around the associated bores 36. These two arrangements provide a kind of bed for receiving the foot, at the heel, and this results in the foot being supported in a highly advantageous manner and located in a sideways direction. In order to avoid the support members being incorrectly fitted into the bores 36 in the situation where the support members 37 are additionally increased in thickness in an upward direction in their end regions, which would result in the opposite effect to that desired, it is desirable for the support members 37 and the associated bores 36 not to be of circular cross-section, but of polygonal cross-section. For example, the cross-section may be of a triangular configuration, with one side of the triangle being disposed parallel to the support surface for the heel so that in use there is no possibility of an undesired variation caused by rotary movement of the support members 37.

In order to facilitate inserting the tube 44 into the bores 36 when the sole is made of given materials, for example rubber, with a correspondingly high frictional value, it is possible to envisage either providing longitudinal ribs on the outside surface of the tube 44, or roughening up the tube so that a lubricant, for example powder, can be provided on the outside surface of the tube.

I claim:

1. A sole for a sports shoe of a soft yielding material, the sole including a tread face, a shank, and a portion thickened rearwardly from the shank to form a heel wedge, the heel wedge comprising a plurality of recesses arranged in a row substantially parallel to each other and extending transversely to the longitudinal axis of the sole and substantially parallel to the tread face and being open at both side edges of the heel wedge, at least one supporting member of elastically bendable material closely fittingly and replaceably inserted into one of said recesses, said bendable material being of greater hardness than said soft yielding material of the sole to increase the overall hardness of the sole, and securing means for securing said at least one supporting member in said recess.

2. A sole according to claim 1, wherein the recess is a bore of circular cross-section and the supporting member in its outer cross-sectional shape and size is adapted to the cross-section of the bore so as to be fittingly insertable into the bore, the recess being narrower in cross-section, at least regionally, than the supporting member which can be fitted therein.

3. A sole according to claim 1, wherein each supporting member carries a collar on one end thereof and at least one circumferential groove at the other end thereof and adapted to receive an elastic ring as said securing means.

4. A sole according to claim 1, wherein the supporting member is in the form of a solid bar of plastics material, capable of deformation in compression and/or deformation in bending and provided at one end thereof with a collar portion intended to bear against the edge of the sole while in the other end portion the bar member has a plurality of spaced-apart annular collar portions.

5. Device for fitting a supporting member into a shoe sole of a soft yielding material and having at least one recess which is open towards opposite edges of the sole, said device comprising a tube which has a pushing and pulling handle and which can be inserted into the recess of the sole while simultaneously expanding the recess, the internal cross-section of the tube, in respect of shape and dimensions, being suitable for receiving a supporting member, and the length of the tube at least approximately corresponding to the length of the recess.

6. A device according to claim 5, the tube being locally expanded outwardly just before its free end, thereby forming a shallow bead, and the free end forming a readily deformable thin-walled edge portion.

7. A sole according to claim 1, wherein each supporting member is a one-piece member extending over the length of the respective recess.

* * * * *